US007921860B1

(12) United States Patent
McQueen

(10) Patent No.: US 7,921,860 B1
(45) Date of Patent: Apr. 12, 2011

(54) COMBINED JAZZY STICK PURSE ASSEMBLY AND ASSOCIATED METHOD

(76) Inventor: Sally McQueen, Brickenridge, MI (US)

( * ) Notice: Subject to any disclaimer, the term of this patent is extended or adjusted under 35 U.S.C. 154(b) by 66 days.

(21) Appl. No.: 12/455,430

(22) Filed: Jun. 2, 2009

Related U.S. Application Data

(63) Continuation-in-part of application No. 11/607,950, filed on Dec. 4, 2006, now abandoned.

(51) Int. Cl.
*A45B 3/10* (2006.01)

(52) U.S. Cl. ..... 135/66

(58) Field of Classification Search ..... 135/34.2, 135/48, 66, 76; 150/106; 224/407
See application file for complete search history.

(56) References Cited

U.S. PATENT DOCUMENTS

| | | | | |
|---|---|---|---|---|
| 257,305 | A | 5/1882 | Charles | |
| 1,526,246 | A | 2/1925 | Wendel | |
| 2,682,904 | A | 7/1954 | Divine | |
| 3,414,133 | A | 12/1968 | Innocenti | |
| 4,730,632 | A | 3/1988 | Mace | |
| 5,161,560 | A | 11/1992 | Sheu | |
| 5,495,866 | A | 3/1996 | Lu | |
| 5,823,213 | A | 10/1998 | Patarra | |
| 7,174,907 | B2 | 2/2007 | Goldsmith | |
| 2003/0136436 | A1 * | 7/2003 | Stepp | 135/66 |

* cited by examiner

*Primary Examiner* — David Dunn
*Assistant Examiner* — Noah Chandler Hawk

(57) ABSTRACT

A combined jazzy stick carrying case assembly includes a plurality of top pockets located about a top section of a carrying case and situated exterior of an outermost surface of the carrying case. A plurality of bottom pockets are located about a bottom section of the carrying case and situated exterior of the outermost surface of the carrying case. In this manner, a first one of the top pockets is isolated from a corresponding first one of the bottom pockets such that the corresponding first bottom pocket has a top opening overlapping about a closed bottom end of the first top pocket. Conversely, a second one of the top pockets is in fluid communication with a corresponding second one of the bottom pockets such that a corresponding second bottom pocket has a top opening in continuous communication with an open bottom end of the second top pocket.

16 Claims, 10 Drawing Sheets

COMBINED JAZZY STICK PURSE ASSEMBLY AND ASSOCIATED METHOD

CROSS REFERENCE TO RELATED APPLICATIONS

This is a continuation in part application of U.S. application Ser. No. 11/607,950, filed Dec. 4, 2006 now abandoned, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to personal item holders and, more particularly, to a combined jazzy stick and purse assembly for allowing a user to safely carry the purse while employing the jazzy stick during walking procedures.

2. Prior Art

Women play multiple roles in any given day (e.g., a morning at the gym, a day at the office, a lunch with friends or colleagues, a late afternoon at the soccer field and an evening out to dinner). Women purchase a multitude of handbags in every color, texture and pattern to match the clothing they wear for each of these events resulting in many problems. For example, one obvious problem is the cost of purchasing so many handbags. In addition, changing handbags daily or multiple times per day to meet the needs of women is not only time consuming but often results in leaving an essential item such as a cell-phone, house key or store return receipt in the prior bag when switched. Other commonly related handbag problems include the inability to clean soil from the handbag's lining and exterior; the handbag that is otherwise good but must be discarded because the bottom is scraped, worn or torn; when traveling, not being able to utilize precious luggage space for clothes because multiple handbags are packed in their place to match the day, evening and casual attire necessary for the trip.

One prior art example shows an interchangeable foundation bag, and foundation bag system. In one embodiment, an interchangeable carrying bag system is provided which includes a discrete inner foundation bag having an inner surface and an outer surface; at least one outer bag having a top periphery, an inner surface, and an outer surface; a first zipper portion connected to the foundation bag; and a second zipper portion connected to the top periphery of a slipcover. The foundation bag, foundation bag system, and method in various embodiments, may preferably use a reversible/non-reversible liner and a reversible/non-reversible handle. Unfortunately, this prior art example does not allow a user to attach a carrying case to an existing cane or other support instrument for use when walking.

Another prior art example shows a portable bag such as a handbag, backpack or the like has an inner pocket for carrying articles and an outer exchangeable cover such as formed from leather, fabric, vinyl or otherwise. The inner pocket includes an upper band which is flexible for pivoting and concealing a fastener therebeneath. The outer cover similarly includes a fastener for engaging the fastener positioned on the inner pocket whereby the outer cover can be slid over the inner pocket and the fasteners secured. Unfortunately, this prior art example also does allow a user to attach a carrying case to an existing cane or other support instrument for use when walking.

Accordingly, a need remains for a combined jazzy stick and purse assembly in order to overcome the above-noted shortcomings. The present invention satisfies such a need by providing an assembly that is convenient and easy to use, is lightweight yet durable in design, and allows a user to safely carry the purse while employing the jazzy stick during walking procedures. Such an assembly conveniently allows a user to attach various sized and shaped carrying cases to existing canes and support instruments so the user can easily carry personal items while utilizing the support instrument. Such an assembly can effectively hold various personal and safety items as desired by a user, thus freeing up a user hand for other endeavors. The present invention is inexpensive, simple to use, and designed for many years of repeated use.

BRIEF SUMMARY OF THE INVENTION

In view of the foregoing background, it is therefore an object of the present invention to provide an assembly for a combined jazzy stick and purse assembly. These and other objects, features, and advantages of the invention are provided by a combined jazzy stick and purse assembly for allowing a user to safely carry the purse while employing the jazzy stick during walking procedures.

The present invention may include a combined jazzy stick purse assembly preferably having an elongated and rectilinear shaft having a unitary body provided with axially opposed top and bottom ends. Such a shaft may have a handle coupled to a top end thereof. A cylindrical core member may be formed from resilient material and may have an axial bore formed therein. In this manner, the shaft may be directly intermitted through the bore such that the core member is telescopically positional along a longitudinal length of the shaft. Notably, the core member has horizontally registered planar top and bottom surfaces defining a continuous outer edge equidistantly spaced from the shaft.

A carrying case may have open top and bottom ends and a centrally aligned chamber extending between the open top and bottom ends. Each of the open top and bottom ends of the carrying case preferably has an elastic fastener concentrically extending thereabout and thereby maintains direct frictional contact about the shaft.

The core member is advantageously contained within the chamber such that the carrying case engulfs and entire surface area of the core member. This helps ensure the carrying case does not prematurely slide down the shaft during extended walking procedures. In this manner, the top and bottom ends of the carrying case directly mate and abut against the top and bottom ends of the core member while a medial portion of the carrying case directly mates and abuts an entire outer surface of the core member respectively. This structural configuration hides the core member within the chamber and thereby linearly slides in sync with the carrying case along a longitudinal length of the shaft.

The present embodiment may further include a stop member maintaining frictional and direct contact with the shaft. Such a stop member may be positioned at a bottom-most end of the shaft.

The carrying case advantageously includes a plurality of top pockets located about a top section of the carrying case and situated exterior of an outermost surface of the carrying case. Such top pockets may be equidistantly spaced about the top section and isolated from the chamber. Also, a plurality of bottom pockets are located about a bottom section of the carrying case and situated exterior of the outermost surface of the carrying case. Such bottom pockets may be equidistantly spaced about the bottom section of the carrying case.

In this manner, a first one of the top pockets is isolated from a corresponding first one of the bottom pockets such that the corresponding first bottom pocket has a top opening overlapping about a closed bottom end of the first top pocket.

Conversely, a second one of the top pockets is in fluid communication with a corresponding second one of the bottom pockets such that a corresponding second bottom pocket has a top opening in continuous communication with an open bottom end of the second top pocket. Notably, the outer surface of the core member is directly abutted against a rear wall of the first and second top and bottom pockets respectively for providing structural rigidity during walking conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1A:
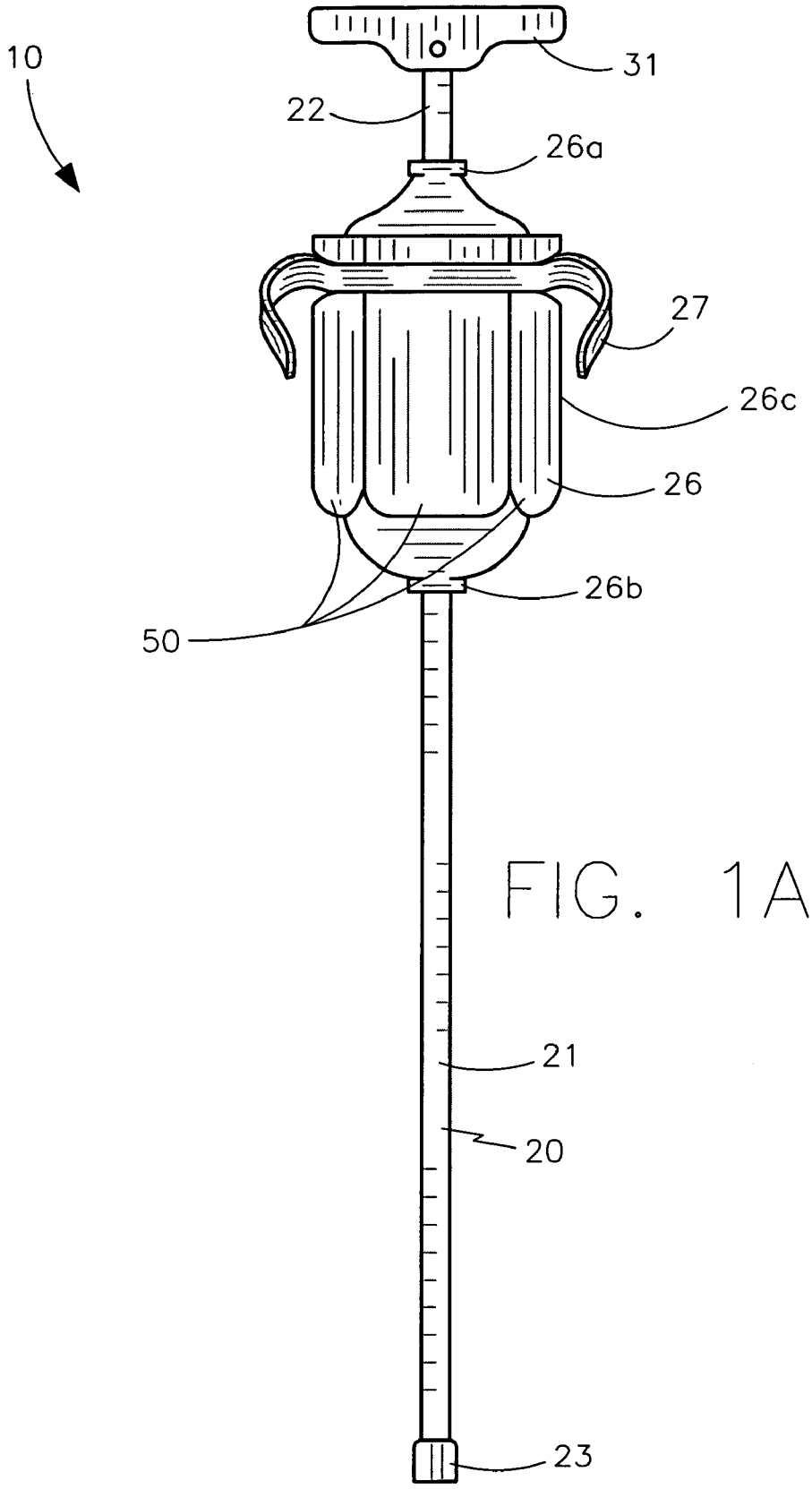
FIG. 1A is a front elevational view of a combined jazzy stick and purse assembly, in accordance with the present invention.
Figure 1B:
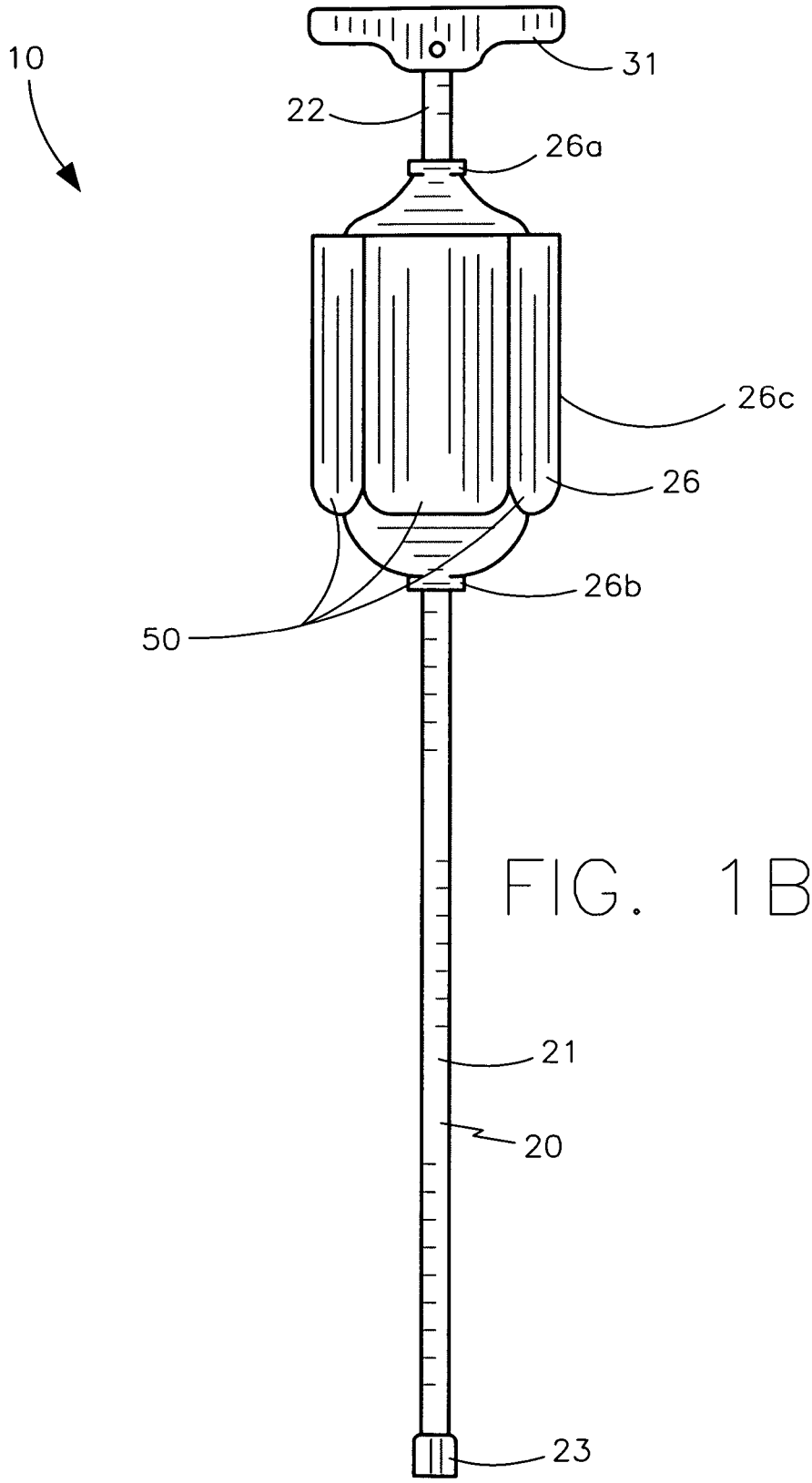
FIG. 1B is a rear elevational view of the assembly shown in FIG. 1A
Figure 2:
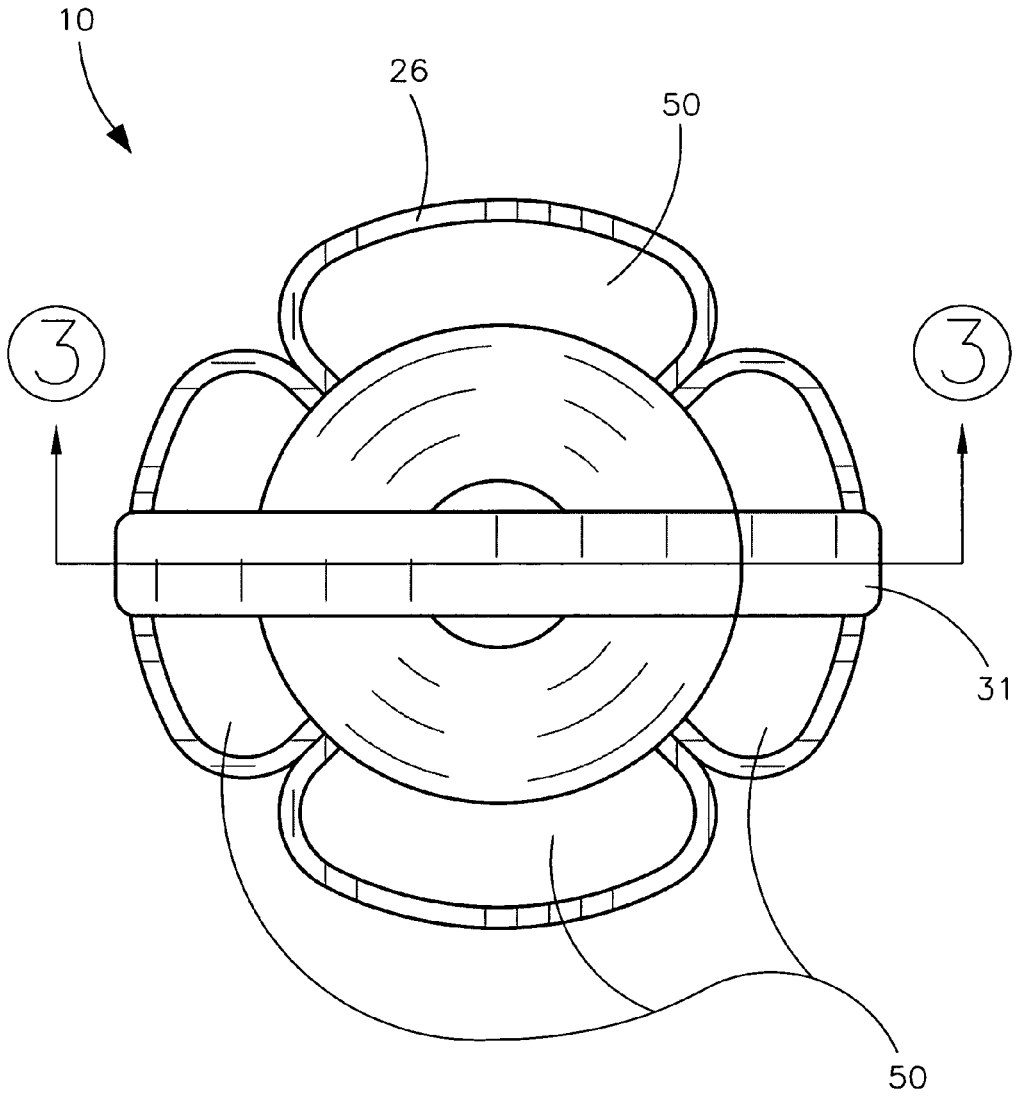
FIG. 2 is a top plan view of the assembly shown in FIG. 1A.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-7B by the reference numeral 10 and 10' and is intended to provide a combined jazzy stick and purse assembly. It should be understood that the assembly 10 and 10' may be used to hold many different types of personal items and should not be limited in use to holding only those items described herein.

Referring initially to FIGS. 1A, 1B, 3A and 3B, the assembly 10 and 10' includes an elongated and rectilinear shaft 20 that has a unitary body 21 provided with axially opposed top 22 and bottom 23 ends, and a cylindrical core member 24 that has an axial bore 25 advantageously formed therein. Such a bore 25 is telescopically positional along a longitudinal length of the shaft 20. The core member 24 has horizontally registered and planar top 24A and bottom 24B surfaces defining a continuous outer edge 30 equidistantly spaced from the shaft 20.

The core member 24 is formed from deformably resilient material, including foam. Standard foam in the industry includes that made from synthetic compounds usually injected into a mold to form a particular shape. Foam material is durable, lightweight and inexpensive, and in addition, most foam material retains its shape and desirable characteristics for many years. Foam can be produced in a variety of shapes and sizes, as well as densities, depending on its use. It is critical that the core member 24 be formed from light weight material and further has durable properties so that the core member does not warp or otherwise deteriorate during extended use. The diameter of the core member 24 can be altered to accommodate various sized and shaped carrying case 26 (described hereinbelow) but it is critical that the core member 24 have a continuous outer edge 30 that provides a support ridge above which the carrying case 26 is weighted.

Referring to FIGS. 1A, 1B, 2, 3A and 3B, the assembly 10 and 10' further includes a carrying case 26 that has open top 26A and bottom 26B ends. An elastic drawstring 27 (or other suitable fastener) is positioned about the carrying case 26 and located below the open top end 26A. Such a drawstring 27 allows a user to secure the open top end 26A of the carrying case 26 and advantageously prevents personal items stored therein from prematurely escaping therefrom. Such a carrying case 26 is adjustably positioned about the core member 24 and the shaft 20, which is essential such that the top and bottom ends 26A, 26B directly mate and abut against the shaft 20, without the use of intervening elements, while a medial portion 26C of the carrying case 26 directly mates and abuts the outer edge 30 of the core member 24, without the use of intervening elements.

Figure 3A:
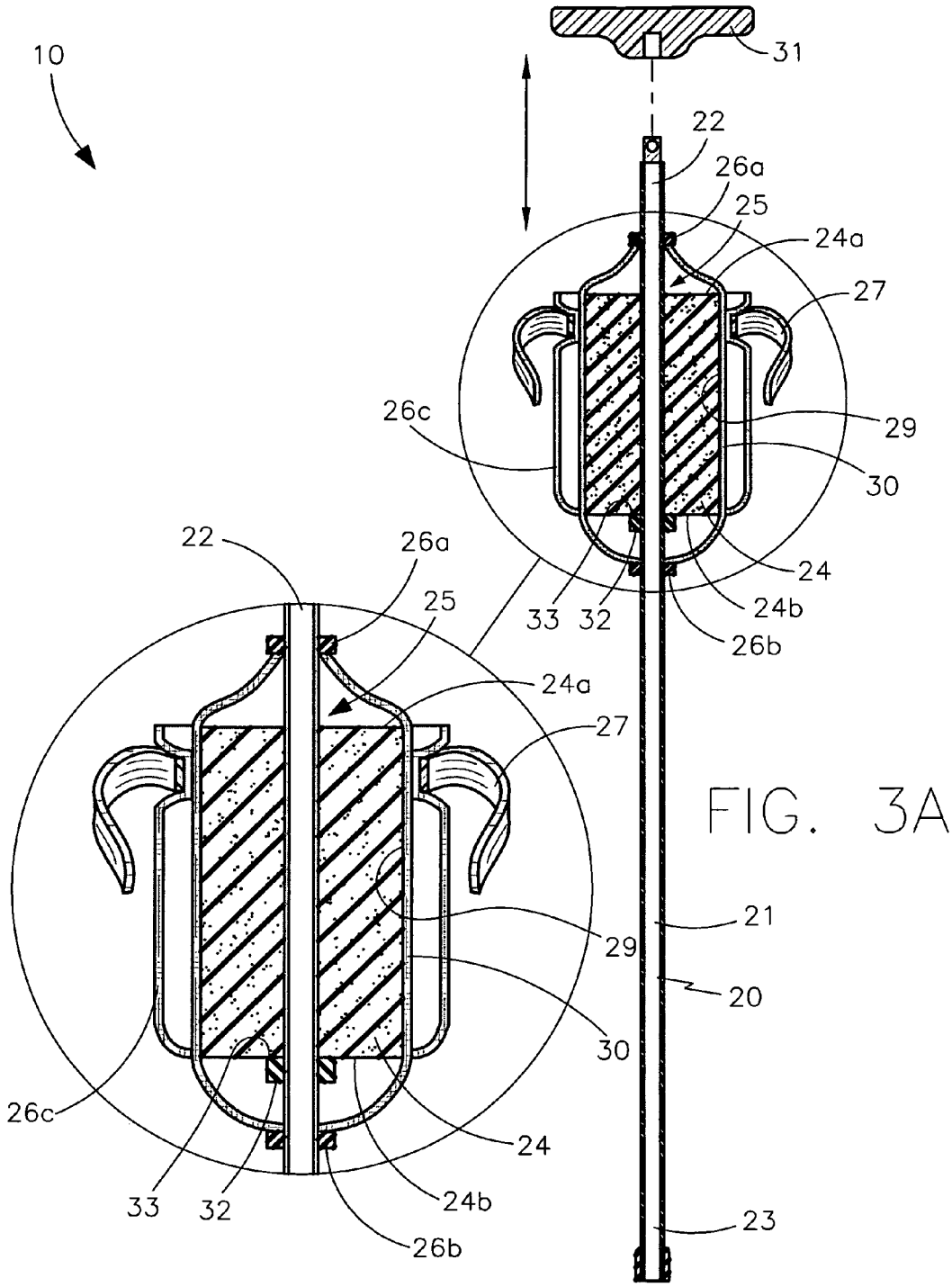
FIG. 3A is an expanded cross sectional view of the apparatus shown in FIG. 2, taken along line 3-3, showing the handle disengaged from the shaft.
Figure 3B:
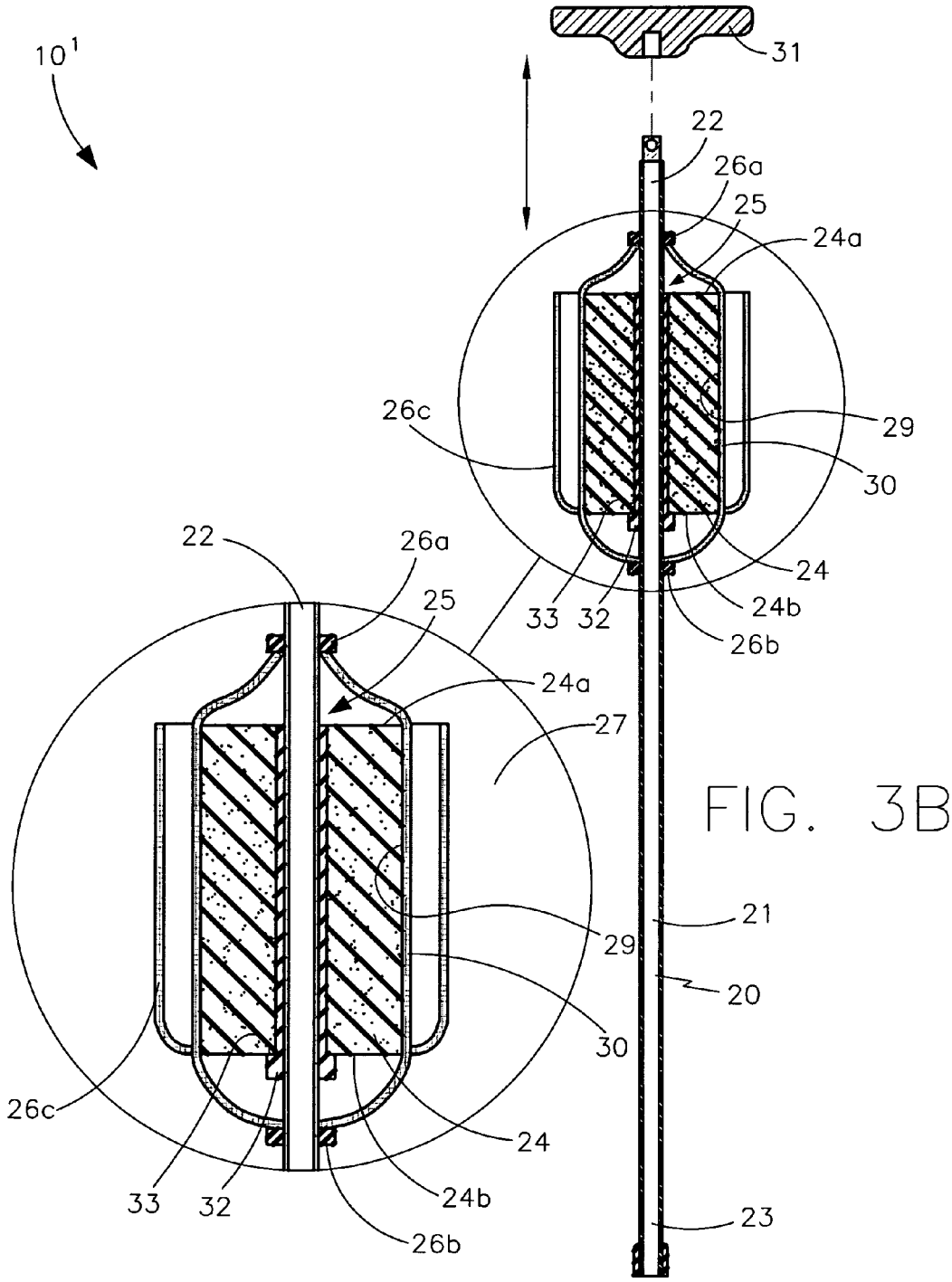
FIG. 3B is an expanded cross sectional view of the apparatus shown in FIG. 3A, in an alternate embodiment.
Figure 4:
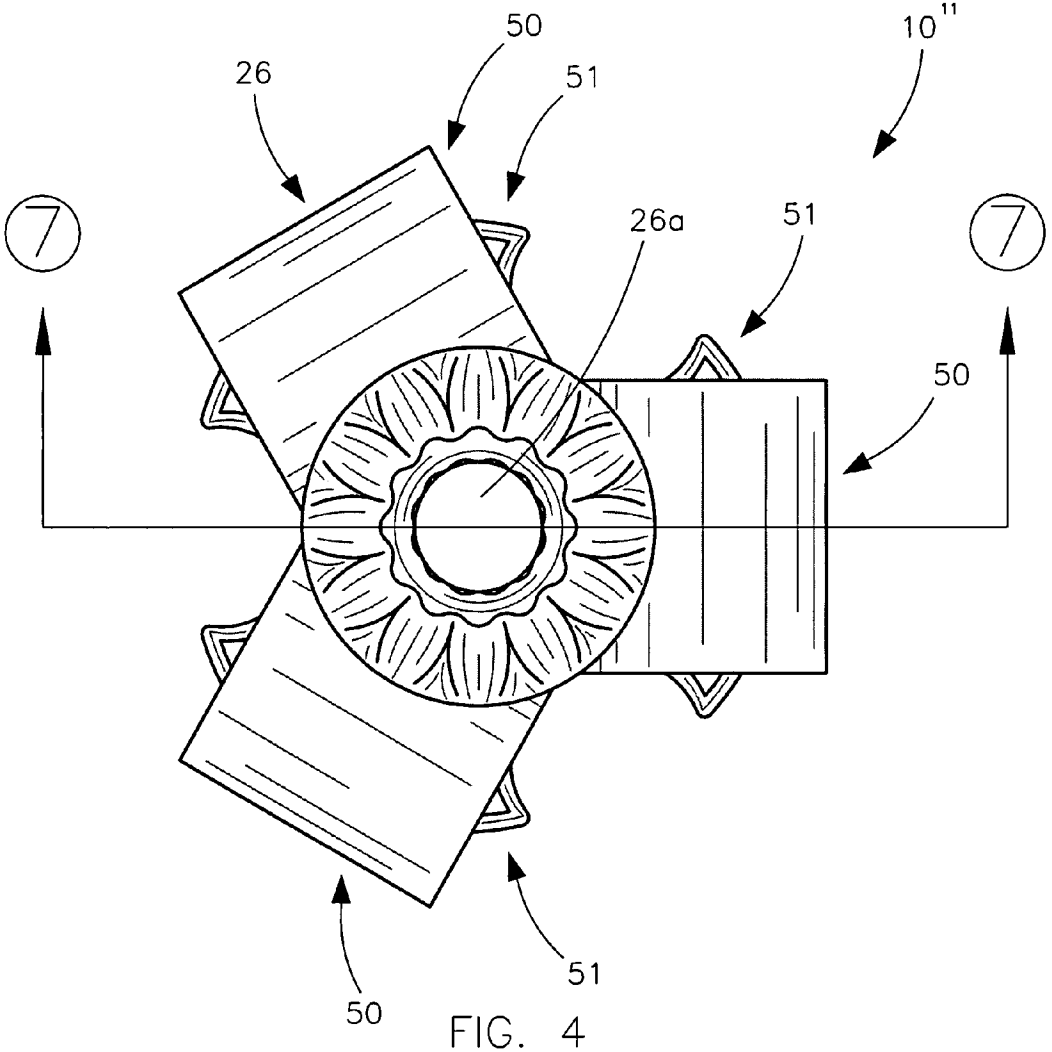
FIG. 4 is a top plan view of a combined jazzy stick and purse assembly, in accordance with yet another embodiment of the present invention.
Figure 5:
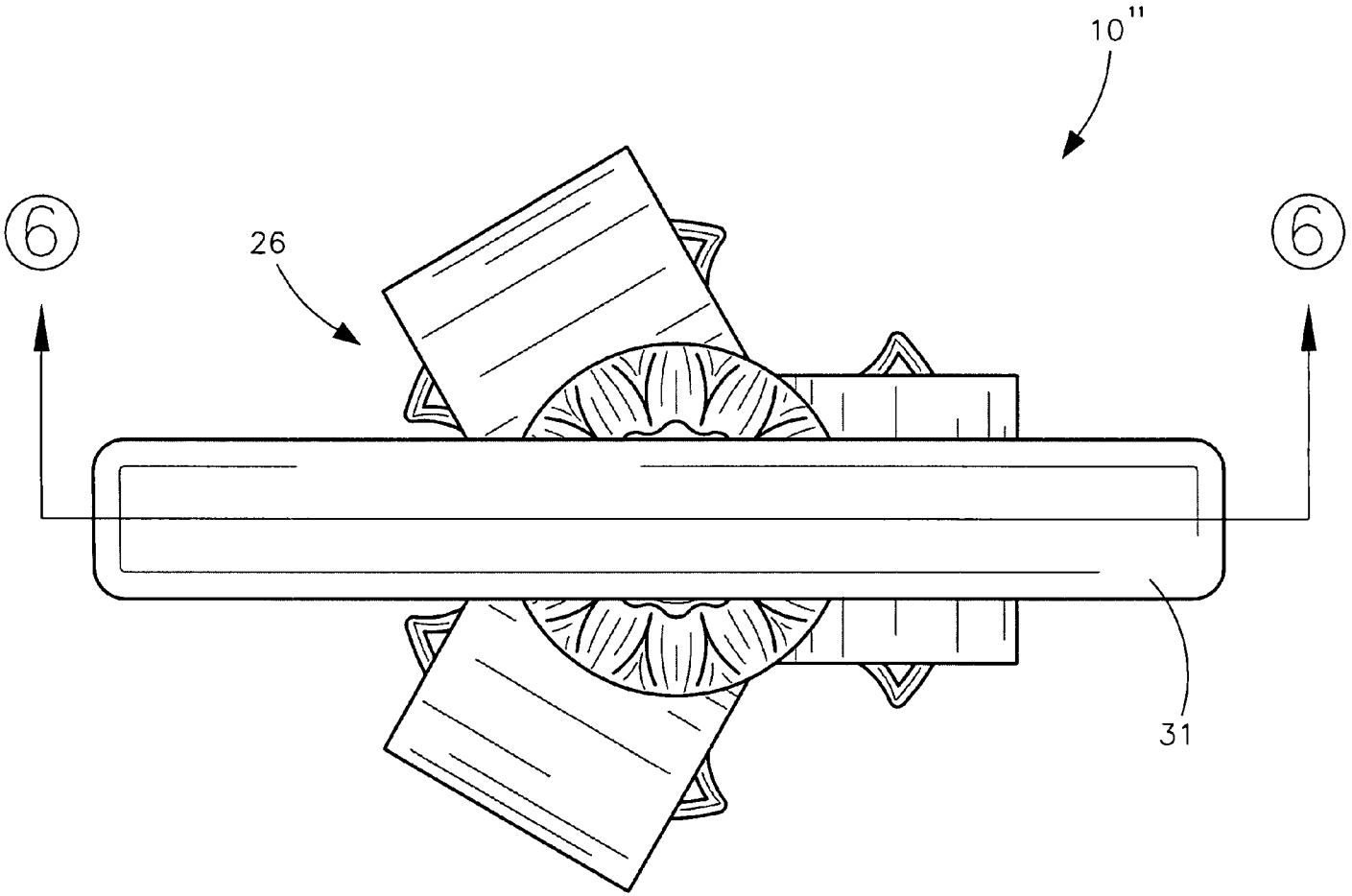
FIG. 5 is a top plane view of FIG. 4 with a cane positioned through the purse.
Figure 6:
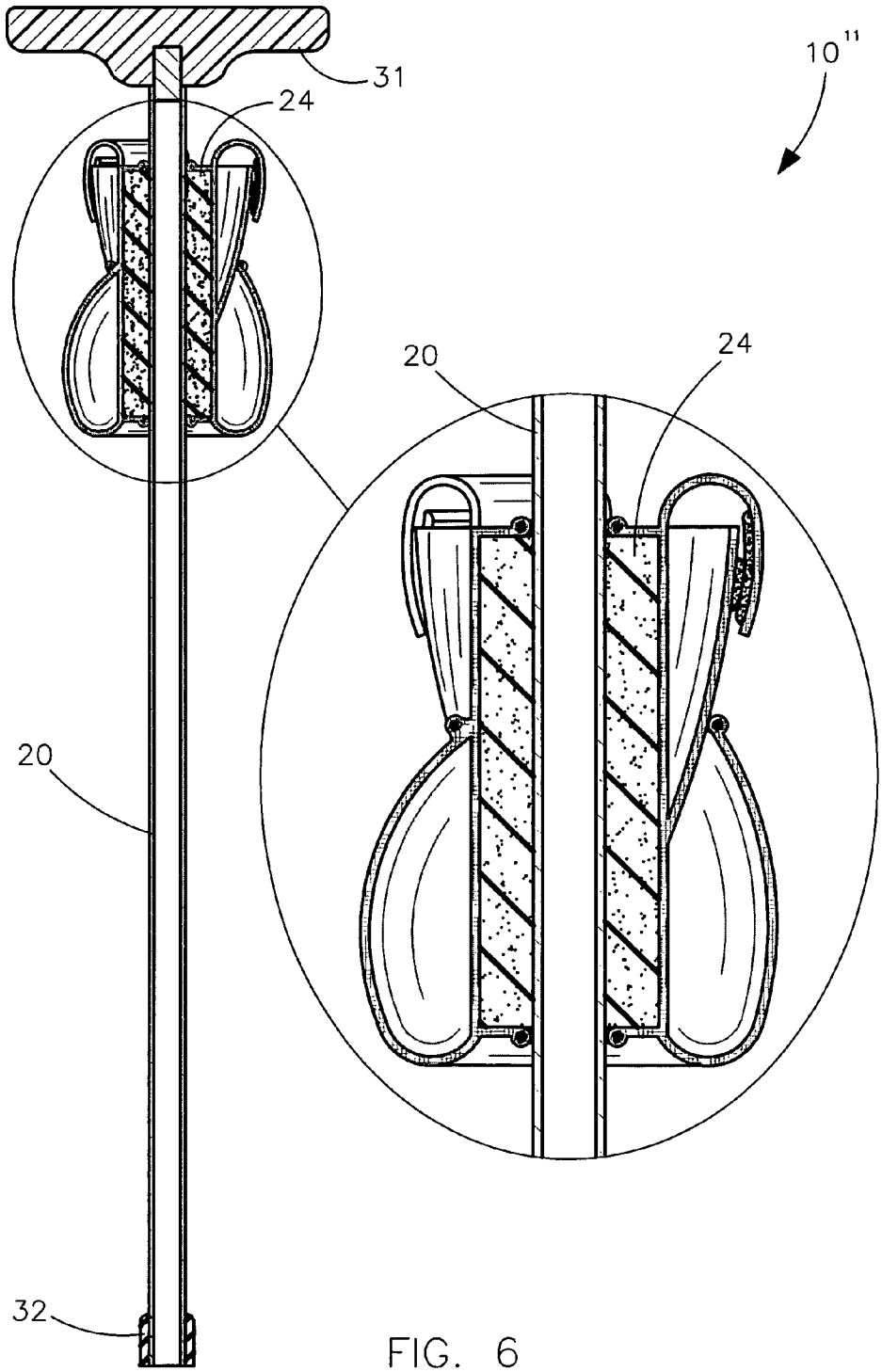
FIG. 6 is a cross-sectional view taken along line 6-6 in FIG. 5.
Figure 7A:
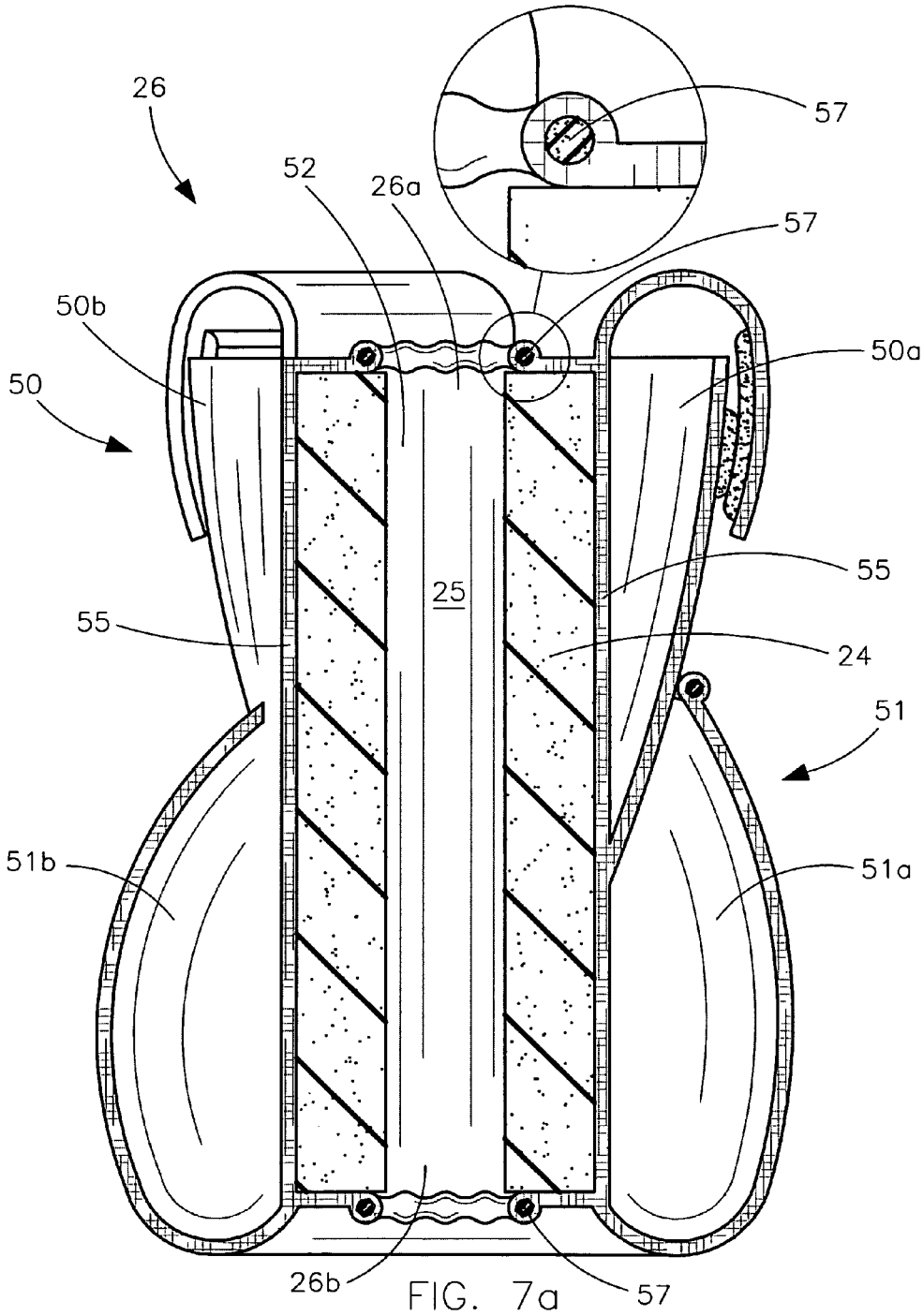
FIGS. 7A-7B are enlarged cross-sectional views showing the purse adapted to alternate positions, in accordance with the embodiment of FIG. 6.
Figure 7B:
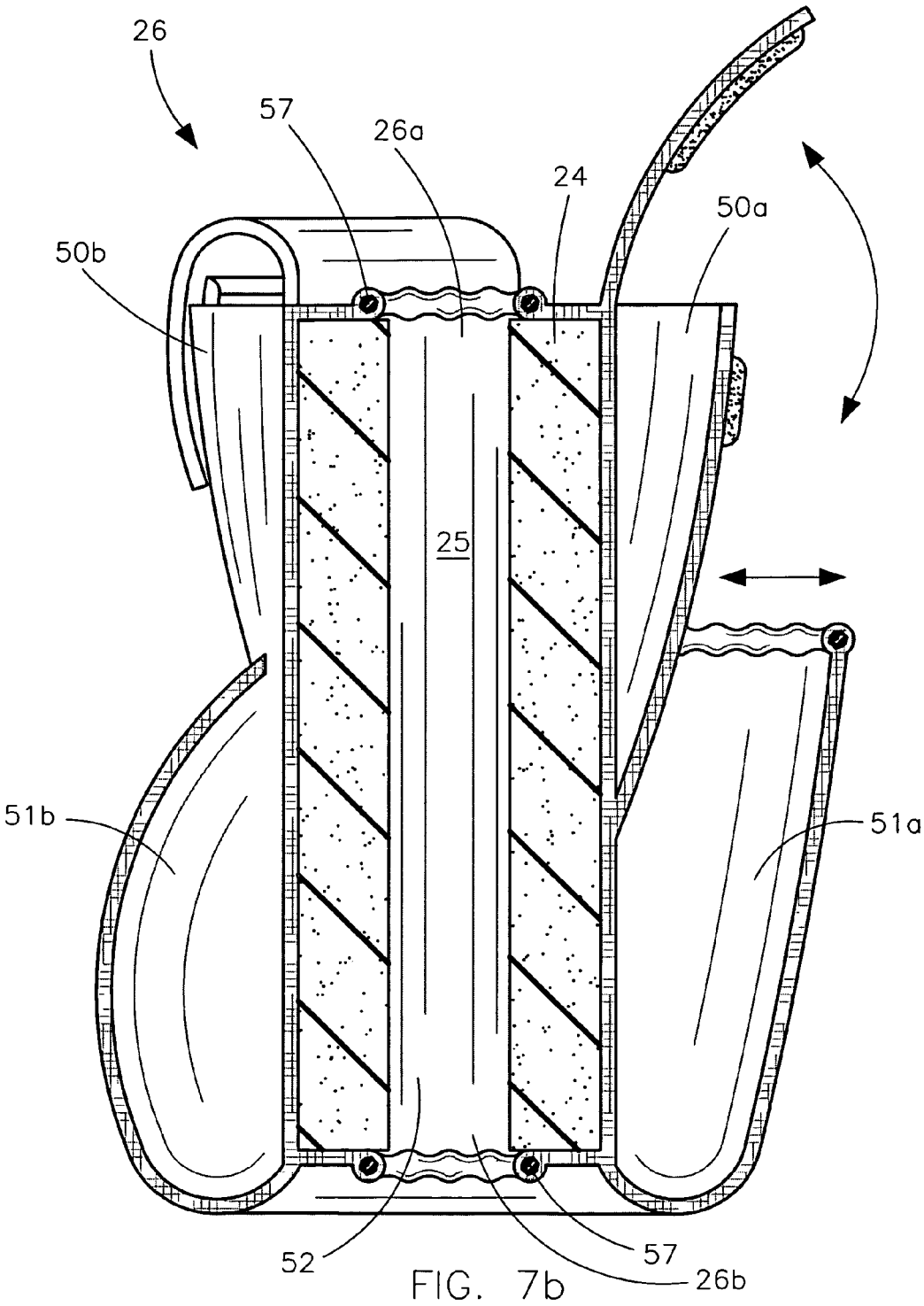

Referring to FIGS. 3A and 3B, the carrying case 26 has an inner surface 29 directly and contiguously anchored on the outer edge 30, without the use of intervening elements, which is critical such that the open top end 26A of the carrying case 26 is prohibited from displacing subjacent of the planar top surface 24A. The carrying case 26 preferably includes a plurality of pockets and individual compartments 50 for holding various personal items as desired by a user. Such pockets and compartments 50 are individually accessible and are secured with a variety of fasteners including buttons, snaps and drawstrings, as examples. Of course, a variety of carrying cases may be supported by the core member 24 and stop member 32, as can be appreciated by one skilled in the art.

Referring to FIGS. 1A, 1B, 2, 3A and 3B, the assembly 10 and 10' further includes a handle 31 directly coupled to the top end 22 of the shaft 20, without the use of intervening elements. In a preferred embodiment, handle 31 is permanently attached to the shaft (such as being monolithically formed therewith). In an alternate embodiment, handle 31 is removably attached to the top end 22 of the shaft 20, which is crucial such that the carrying case 26 and the core member 24 can be telescopically disengaged from the shaft 20. A stop member 32 maintains frictional and direct contact with the shaft 20, without the use of intervening elements, and is advantageously positioned directly beneath the core member 24, without the use of intervening elements. Such a stop member 32 has an annular shape and is provided with a planar top surface 33 directly abutted against the planar bottom surface 24B of the core member 24, without the use of intervening elements. The stop member 32 is disposed intermediately of the open top and bottom ends 26A, 26B of the carrying case 26, which is vital such that the stop member 32 is invisible from an exterior line of sight. It is noted that the present invention may be practiced without employing the stop member 32 so long as the core member bore 25 is sufficiently narrow for maintaining a frictional relationship with the shaft 20.

Referring to FIG. 3B, in an alternate embodiment 10', the stop member 32' includes a top portion 33 defining a sleeve 34 positioned about the shaft 20 and advantageously extending along an entire longitudinal length of the core member 24, which is important such that the sleeve 34 is intercalated between the shaft 20 and the core member 24. Such a sleeve 34 is permanently and directly connected to an inner surface 35 of the bore 25, without the use of intervening elements. A bottom portion 36 defining a plug 36 is monolithically formed in the sleeve 34 and is positioned beneath the core member 24. The sleeve 34 and the plug 36 cooperate and maintain a continuous frictional force defined along the entire longitudinal length of the core member 24 for advantageously prohibiting the core member 24 from undesirably displacing along the shaft 20.

The combination of core member 24 and stop member 32 frictionally engaged along shaft 20 provides the unexpected benefit of allowing a user to attach a carrying case 26 of their choice to a support instrument for allowing the user to safely and confidently walk while also carrying needed personal items in a secure and convenient manner, thereby overcoming prior art shortcomings.

Now referring to the embodiment of FIGS. 4-7B, the present invention may include a combined jazzy stick purse assembly 10" preferably having an elongated and rectilinear shaft 20 having a unitary body provided with axially opposed top and bottom ends. Such a shaft 20 may have a handle 31 coupled to a top end thereof. A cylindrical core member 24 may be formed from resilient material and may have an axial bore 25 formed therein. In this manner, the shaft 20 may be directly intermitted through the bore 25 such that the core member 24 is telescopically positional along a longitudinal length of the shaft 20. Notably, the core member 24 has horizontally registered planar top and bottom surfaces defining a continuous outer edge equidistantly spaced from the shaft 20.

A carrying case 26 may have open top and bottom ends 26A, 26B and a centrally aligned chamber 52 extending between the open top and bottom ends 26A, 26B. Each of the open top and bottom ends 26A, 26B of the carrying case 26 preferably has an elastic fastener 57 concentrically extending thereabout and thereby maintains direct frictional contact about the shaft 20.

The core member 24 is advantageously contained within the chamber 52 such that the carrying case 26 engulfs and entire surface area of the core member 24. This helps ensure the carrying case 26 does not prematurely slide down the shaft 20 during extended walking procedures. In this manner, the top and bottom ends 26A, 26B of the carrying case 26 directly mate and abut against the top and bottom ends of the core member 24 while a medial portion of the carrying case 26 directly mates and abuts an entire outer surface of the core member 24 respectively. This structural configuration hides the core member 24 within the chamber 52 and thereby linearly slides in sync with the carrying case 26 along a longitudinal length of the shaft 20.

The present embodiment may further include a stop member 32 maintaining frictional and direct contact with the shaft 20. Such a stop member 32 may be positioned at a bottommost end of the shaft 20.

The carrying case 26 advantageously includes a plurality of top pockets 50 located about a top section of the carrying case 26 and situated exterior of an outermost surface of the carrying case 26. Such top pockets 50 may be equidistantly spaced about the top section and isolated from the chamber 52. Also, a plurality of bottom pockets 51 are located about a bottom section of the carrying case 26 and situated exterior of the outermost surface of the carrying case 26. Such bottom pockets 51 may be equidistantly spaced about the bottom section of the carrying case 26.

In this manner, a first one 50A of the top pockets 50 is isolated from a corresponding first one 51A of the bottom pockets 51 such that the corresponding first bottom pocket 51A has a top opening overlapping about a closed bottom end of the first top pocket 50A. Conversely, a second one 50B of the top pockets 50 is in fluid communication with a corresponding second one 51B of the bottom pockets 51 such that the corresponding second bottom pocket 51B has a top opening in continuous communication with an open bottom end of the second top pocket 50B. Notably, the outer surface of the core member 24 is directly abutted against a rear wall 55 of the first and second top and bottom pockets 50, 51 respectively for providing structural rigidity during walking conditions. In this manner, the rear wall 55 remains planar and vertically aligned in parallel to a longitudinal length of the bore 25.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined jazzy stick and purse assembly for allowing a user to safely carry the purse while employing the jazzy stick during walking procedures, said combined jazzy stick and purse assembly comprising:

an elongated and rectilinear shaft having a unitary body provided with axially opposed top and bottom ends;

a cylindrical core member having an axial bore formed therein, said shaft being directly intermitted through said bore such that said core member is telescopically positional along a longitudinal length of said shaft, said core member having horizontally registered planar top and bottom surfaces defining a continuous outer edge equidistantly spaced from said shaft; and a carrying case having open top and bottom ends and a centrally aligned chamber extending between said open top and bottom ends, each of said open top and bottom ends of said carrying case having an elastic fastener concentrically extending thereabout and thereby maintaining direct frictional contact about said shaft, said core member being contained within said chamber such that said carrying case engulfs and entire surface area of said core member.

2. The combined jazzy stick and purse assembly of claim 1, wherein said top and bottom ends of said carrying case directly mate and abut against said top and bottom ends of said core member while a medial portion of said carrying case directly mates and abuts an entire outer surface of said core member respectively.

3. The combined jazzy stick and purse assembly of claim 1, wherein said core member is hidden within said chamber and thereby linearly slides in sync with said carrying case along a longitudinal length of said shaft.

4. The combined jazzy stick and purse assembly of claim 1, further comprising: a stop member maintaining frictional and direct contact with said shaft, said stop member being positioned at a bottom-most end of said shaft.

5. The combined jazzy stick and purse assembly of claim 1, wherein said carrying case comprises:

a plurality of top pockets located about a top section of said carrying case and situated exterior of an outermost surface of said carrying case, said top pockets being equidistantly spaced about said top section and isolated from said chamber; and a plurality of bottom pockets located about a bottom section of said carrying case and situated exterior of said outermost surface of said carrying case, said bottom pockets being equidistantly spaced about said bottom section of said carrying case.

6. The combined jazzy stick and purse assembly of claim 5, wherein a first one of said top pockets is isolated from a corresponding first one of said bottom pockets, said corresponding first bottom pocket having a top opening overlapping about a closed bottom end of said first top pocket.

7. The combined jazzy stick and purse assembly of claim 6, wherein a second one of said top pockets is in fluid communication with a corresponding second one of said bottom pockets, said corresponding second bottom pocket having a top opening in continuous communication with an open bottom end of said second top pocket.

8. The combined jazzy stick and purse assembly of claim 7, wherein said outer surface of said core member is directly abutted against a rear wall of said first and second top and bottom pockets respectively.

9. A combined jazzy stick and purse assembly for allowing a user to safely carry the purse while employing the jazzy stick during walking procedures, said combined jazzy stick and purse assembly comprising:

an elongated and rectilinear shaft having a unitary body provided with axially opposed top and bottom ends; said shaft further having a handle coupled to a top end thereof;

a cylindrical core member formed from resilient material and having an axial bore formed therein, said shaft being directly intermitted through said bore such that said core member is telescopically positional along a longitudinal length of said shaft, said core member having horizontally registered planar top and bottom surfaces defining a continuous outer edge equidistantly spaced from said shaft; and a carrying case having open top and bottom ends and a centrally aligned chamber extending between said open top and bottom ends, each of said open top and bottom ends of said carrying case having an elastic fastener concentrically extending thereabout and thereby maintaining direct frictional contact about said shaft, said core member being contained within said chamber such that said carrying case engulfs and entire surface area of said core member.

10. The combined jazzy stick and purse assembly of claim 9, wherein said top and bottom ends of said carrying case directly mate and abut against said top and bottom ends of said core member while a medial portion of said carrying case directly mates and abuts an entire outer surface of said core member respectively.

11. The combined jazzy stick and purse assembly of claim 9, wherein said core member is hidden within said chamber and thereby linearly slides in sync with said carrying case along a longitudinal length of said shaft.

12. The combined jazzy stick and purse assembly of claim 9, further comprising: a stop member maintaining frictional and direct contact with said shaft, said stop member being positioned at a bottom-most end of said shaft.

13. The combined jazzy stick and purse assembly of claim 9, wherein said carrying case comprises:

a plurality of top pockets located about a top section of said carrying case and situated exterior of an outermost surface of said carrying case, said top pockets being equidistantly spaced about said top section and isolated from said chamber; and a plurality of bottom pockets located about a bottom section of said carrying case and situated exterior of said outermost surface of said carrying case, said bottom pockets being equidistantly spaced about said bottom section of said carrying case.

14. The combined jazzy stick and purse assembly of claim 13, wherein a first one of said top pockets is isolated from a corresponding first one of said bottom pockets, said corresponding first bottom pocket having a top opening overlapping about a closed bottom end of said first top pocket.

15. The combined jazzy stick and purse assembly of claim 14, wherein a second one of said top pockets is in fluid communication with a corresponding second one of said bottom pockets, said corresponding second bottom pocket having a top opening in continuous communication with an open bottom end of said second top pocket.

16. The combined jazzy stick and purse assembly of claim 15, wherein said outer surface of said core member is directly abutted against a rear wall of said first and second top and bottom pockets respectively.

* * * * *